United States Patent [19]

Murano et al.

[11] 3,968,393

[45] July 6, 1976

[54] SPARK GAP DEVICE FOR A LIGHTNING ARRESTOR

[75] Inventors: Minoru Murano, Tokyo; Satoru Yanabu; Susumu Nishiwaki, both of Yokohama; Soji Kojima, Yokosuka; Teiichi Ueki, Yokohama, all of Japan

[73] Assignee: Tokyo Shibaura Electric Co., Ltd., Kawasaki, Japan

[22] Filed: Mar. 27, 1975

[21] Appl. No.: 562,770

[52] U.S. Cl. ..... 313/325; 315/35; 317/61; 317/69; 317/73

[51] Int. Cl.[2] ..... H01J 17/00; H01J 21/00

[58] Field of Search ..... 313/325; 315/35, 36; 317/69, 73, 61

[56] References Cited

UNITED STATES PATENTS

| | | | |
|---|---|---|---|
| 3,443,149 | 5/1969 | Hazen | 315/36 |
| 3,576,459 | 4/1971 | Sakshaug et al. | 313/325 |
| 3,614,536 | 10/1971 | Johansson | 313/325 |
| 3,663,856 | 5/1972 | Miske, Jr. | 315/36 |
| 3,688,155 | 8/1972 | Johansson et al. | 315/36 |
| 3,883,774 | 5/1975 | Volkenau et al. | 315/36 |

*Primary Examiner*—Saxfield Chatmon, Jr.
*Attorney, Agent, or Firm*—Finnegan, Henderson, Farabow & Garrett

[57] ABSTRACT

Within an arc extinguishing chamber are disposed a pair of main electrodes so as to cause a spark starting gap to be defined therebetween. A single auxiliary electrode is also disposed so as to cause reignition in those interspaces between the auxiliary electrode and the respective main electrodes at positions distant from said spark starting gap. Further, paths for supplying therethrough a heated gas to the reigniting spark gaps when the feet at one side of the arcs between the respective main electrodes and the auxiliary electrode have arrived at the prescribed points of the auxiliary electrode are provided.

12 Claims, 27 Drawing Figures

SPARK GAP DEVICE FOR A LIGHTNING ARRESTOR

BACKGROUND OF THE INVENTION

This invention relates to a spark gap device for a lightning arrestor suited for protection of a direct current transmission line, and more particularly to a spark gap device for a lightning arrestor wherein reigniting spark gaps are provided at positions different from that at which a spark starting gap is provided.

The more increased the transmission voltage is, the more important the role of the lightning arrestor connected to the transmission line becomes. Generally, the surge energy produced in the transmission line is substantially proportional to the second power of the transmission voltage. The actual circumstance, however, is that the performance of the lightning arrestor is not elevated to such an extent as is sufficient to resist the increasing transmission voltage. The electrostatic capacity of a cable used for the direct current transmission is as large as approximately 30 times that of an overhead wire used for the alternating current transmission. Accordingly, the amount of surge energy produced in a long direct current transmission line is extremely large and this large amount of surge energy should not be treated by the lightning arrestor but the following current interruption, namely, the direct current interruption should also be performed by the lightning arrestor. Accordingly, with the prior art lightning arrestor it is difficult to protect the alternating current transmission line of a voltage higher than, for example, 500 kv or long-distance direct current transmission line. Generally, the lightning arrestor is connected to the direct current transmission line as shown in FIG. 1A. That is to say, the output from a transformer Tr is transmitted to a power receiving end through an AC-DC converter Rf, smoothing reactor L and DC transmission line DCL. A first lightning arrestor LA1 is connected between the junction point between the smoothing reactor L and the transmission line DCL and ground, and a second lightning arrestor LA2 is connected between the junction point between the smoothing reactor L and the AC-DC converter Rf and ground. The waveforms of surge currents flowing in said lightning arrestor when the arrestors are in their normal operations are shown in, for example, FIGS. 1B and 1C. The peak value ip of the surge current flowing in the lightning arrestor LA1 amounts to as large a value as 1000 amperes to 3000 amperes and, in the case of the long-distance transmission line, the lasting time $t$ of the surge current thereof is as long as, for example, 5 milliseconds due to the lumped capacity. On the other hand, since the surge current flowing in the arrestor LA2 flows therein through the reactor L, the peak value $ip'$ thereof becomes smaller than said peak value ip as shown in FIG. 1C. In this case, however, the lasting time $t'$ thereof sometimes is as long as 10 milliseconds. The arrestors LA1 and LA2 are respectively comprised of a plurality of series-connected spark gap devices and a non-linear resistance element serially connected to said devices, which are received within an airtight chamber into which, for example, a nitrogen gas is charged or sealed. The prior art spark gap device is constructed such that a pair of main electrodes are disposed within an arc extinguishing chamber constituted by two arc extinguishing plates so as to form a starting spark gap, and an arc produced at the starting spark gap is driven by the magnetic field produced due to the current flowing in a coil (not shown) connected in series to said starting spark gap, or the magnetic field produced from a permanent magnet not shown so that the arc is extended within the chamber. The arc thus extended is rapidly cooled when contacted with the inner walls of the arc extinguishing chamber, to cause the arc voltage to be increased, so that the arc current, accordingly, the following current is interrupted. For the purpose of performing the cooling effectively, the thickness of the chamber portion (i.e., a distance between the inner walls of the two arc extinguishing plates) where the arc extended up to a final position is passed is rendered smaller than that of the chamber portion where the arc in the course of being extended is driven toward the final position. The spark gap device having the foregoing construction is called a current limiting-spark gap device and has the following drawbacks.

1. Since the arc current is confined for approximately 5 milliseconds within that chamber portion having said smaller thickness which corresponds to said final position of the arc, the corresponding arc extinguishing plate portion is likely to be carbonized or fused. In such a case, it is impossible to increase the arc voltage level and therefore to perform the following current or direct current interruption.

2. Difficulty is presented in decreasing the switching surge voltage level to below a limiting level. Generally, the switching surge voltage level is required to be limited to less than a prescribed level. As above described, however, even in the case where the switching surge voltage is treated, the arc is quickly driven up to the final position. By adding the IR voltage drop of said non-linear resistance element of the arrestor to said arc voltage, the limiting level of the switching surge voltage is determined. When the switching surge current is increased in amount, said IR voltage drop is also increased, so that it is necessary to reduce the arc voltage in level. But the arc voltage level can not be reduced to a desired extent.

3. Long flow of the surge current causes the arc extinguishing chamber to be deteriorated or damaged and an increase in the arc voltage level within a small length of time fails to decrease the limiting level of the surge voltage, so that it is difficult to sufficiently absorb the switching surge energy.

For the purpose of eliminating the above-enumerated drawbacks a spark gap device having the following construction has been proposed. The spark gap device is so constructed that while the surge current remains to have a value greater than prescribed, reignition is repeatedly caused between two main electrodes; and when the surge current value is reduced to a value smaller than prescribed, the arc is extended up to a final position and interrupted. In more detail, the main electrodes are respectively provided with a groove extending from a prescribed position of each main electrode to the starting spark gap. When the foot of an arc produced in the starting spark gap has arrived at said prescribed position, an ionized heated gas occurring at the prescribed position is supplied to the starting spark gap through said groove. In this case, during the period in which the surge current value remains greater than prescribed, reignition is repeatedly caused in said starting spark gap, whereas when said surge current value is reduced to a value smaller than prescribed, the ionized heated gas supplied to the starting spark gap does not cause the occurrence therein of reignition. Accordingly, the arc so limited as to have a small current value is extended up to a prescribed position and interrupted. The spark gap device having the foregoing construction is called a reigniting spark gap device, which is capable of eliminating the previously mentioned drawbacks (1), (2) and (3).

Since, however, reignition is caused in an interspace between the main electrodes and yet caused in the interspace portion where the starting spark is caused or in the proximity thereof, the insulation recovery between the main electrodes after the following current interruption is delayed, and further the metal material constituting the main electrode portion where the starting spark is caused is likely to be damaged and in such cases the starting spark characteristics are undesirably varied. Therefore, the use of the arrestor having the above-constructed spark gap device for protection of the direct current transmission line can not be said to sufficiently serve the purpose.

Accordingly, the object of the invention is to provide a spark gap device for a lightning arrestor capable of eliminating the drawbacks encountered with the aforesaid current limiting-spark gap device for a lightning arrestor and the aforesaid reigniting-spark gap device for a lightning arrestor.

SUMMARY OF THE INVENTION

The spark gap device of the invention comprises an arc extinguishing chamber defined by arc extinguishing plates, a pair of main electrodes disposed within said arc extinguishing chamber in a manner facing each other so as to form a spark starting gap, an auxiliary electrode so disposed as to form reigniting spark gaps with respect to respective said main electrodes, and heated gas paths for allowing the space portions of the arc extinguishing chamber respectively corresponding to said reigniting spark gaps to communicate with the space portions of the arc extinguishing chamber adjacent the auxiliary electrode face opposite to that adjacent the first mentioned space portions, whereby reignition is caused at the interspaces between the auxiliary electrode and the respective main electrodes.

According to the invention, arrival of the surge voltage causes generation of an arc in the starting spark gap between the main electrodes. In the course of being driven by a driving magnetic field, said arc is divided into two parts, one of which is the arc between one of the main electrodes and the auxiliary electrode and the other of which is the arc between the other of the main electrodes and the auxiliary electrode. When the feet at one side of said arcs have arrived at prescribed positions of the auxiliary electrode, an ionized heated gas is supplied through said heated gas paths to the space portions of the arc extinguishing chamber respectively corresponding to the reigniting spark gaps and the proximities thereof. Accordingly, during the period in which the surge current level is higher than prescribed, reignition is repeatedly caused in said respective reigniting spark gaps. When the surge current level becomes lower than prescribed, no reignition is caused and said arcs are driven up to the final position and extinguished.

Since, according to the invention, the arc drop can be maintained small during the period in which the surge current level is higher than prescribed, the limiting level of the switching surge voltage can be reduced and simultaneously the surge energy absorbing capacity can be increased. Further, since there is no necessity of confining the arc current in a specified position within the arc extinguishing chamber for a long time, deterioration of the chamber can be prevented. Accordingly, it is apparent that the spark gap device of the invention is capable of removing the drawbacks of the prior art current limiting-spark gap device. Further, since, according to the invention, the reignition is caused not in an interspace between the main electrodes but in those interspaces between the respective main electrodes and the auxiliary electrode which are distant from the starting spark gap between the main electrodes, it is also apparent that the present device is capable of removing the drawbacks of the prior art reigniting-spark gap device.

This invention can be practised in various modifications as shown in respective embodiments as later described.

PREFERRED EMBODIMENTS OF THE INVENTION

Figure 2B:
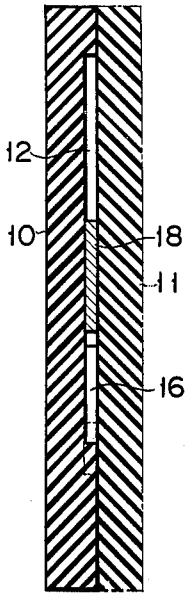
FIGS. 2A and 2B illustrate a first embodiment of the spark gap device according to the invention, FIG. 2A being a plan view illustrating the inner construction of the first embodiment, FIG. 2B being a sectional view taken along the line B—B of FIG. 2A.
Figure 2A:
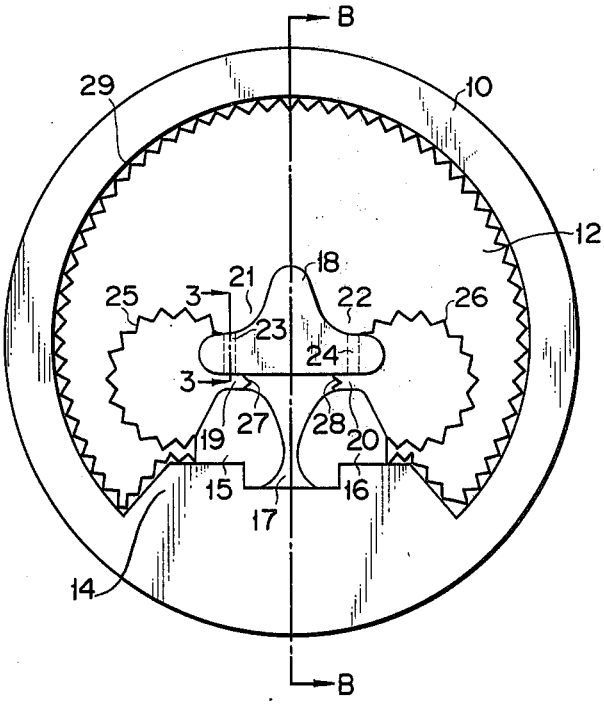

In embodiments hereinafter described, the identical parts and sections are denoted by the identical reference numerals and, unless particularly required, duplication of description thereof is avoided. Referring to FIGS. 2A and 2B, a first arc extinguishing plate 10 made of a heat-resistant insulating material is superposed on a second arc extinguishing plate 11 made of the same material to form an arc extinguishing chamber 12 therebetween. On the first arc extinguishing plate there is provided a base portion 14, to which a pair of main electrodes 15 and 16 are fixed so as to form a spark starting gap 17. A single auxiliary electrode 18 is fixed to the first arc extinguishing plate 10 so as to define reigniting spark gaps 19 and 20 with the paired main electrodes, respectively. In this invention, a distance between the inner surfaces of the arc extinguishing plates constituting an arc extinguishing chamber is defined as the "depth" of the chamber. The main electrodes are each electrically drawn out exteriorly of the arc extinguishing plate for being series-connected to another spark gap device, though illustration thereof is not made. Paths 23 and 24 are provided which allow the space portions of the arc extinguishing chamber corresponding to the reigniting spark gaps 19 and 20 to communicate with the space portions 21 and 22 of the arc extinguishing chamber adjacent an auxiliary electrode face opposite to that adjacent the first mentioned space portions. Though not shown, a magnetic field whose flux intersects the arc extinguishing plate surface substantially at right angles is applied to the arc.

Figure 1A:
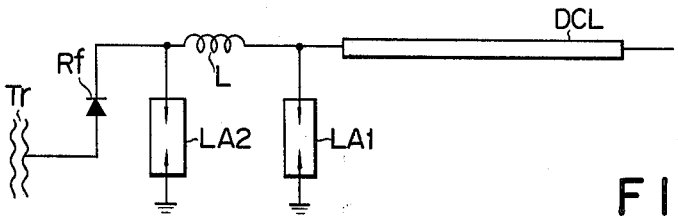
FIGS. 1A to 1C illustrate the mode in which a DC transmission line is protected by lightning arrestors each comprised of the spark gap device of the invention, FIG. 1A illustrating a typical circuit diagram for protection of the DC transmission line, FIG. 1B illustrating a current waveform flowing in the lightning arrestor LA1, FIG. 1C illustrating a current waveform flowing in the lightning arrestor LA2.
Figure 1B:
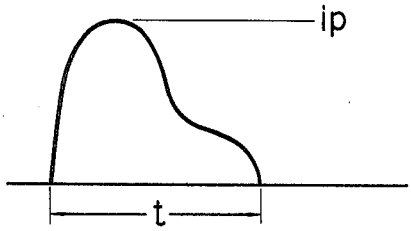
Figure 1C:
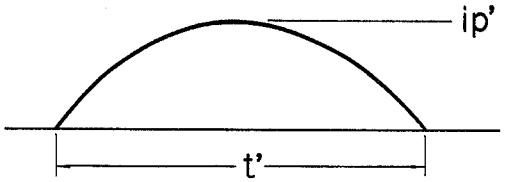

In the spark gap device having the foregoing construction, when a surge voltage having a level higher than prescribed is applied between the main electrodes, an arc is produced in the spark starting gap 17. This arc is driven by the magnetic field and is thereby divided into two parts one 27 of which is the arc between one main electrode 15 and the auxiliary electrode 18 and the other 28 of which is the arc between the other main electrode 16 and the auxiliary electrode 18. The resulting arcs are further extended to become such arcs as indicated by numerals 25 and 26, respectively, the upper feet of said arcs reaching the upper openings, respectively, of the paths 23 and 24. A high heated ionized gas generated in the respective vicinities of said upper openings is supplied to the chamber portions corresponding to the reigniting spark gaps 19 and 20 through said paths. Accordingly, the arcs 27 and 28 are produced in said reigniting spark gaps 19 and 20. While the level of a surge current is higher than prescribed (as shown in FIGS. 1B and 1C, the period during which the surge current level is higher than predetermined is several milliseconds), the reignition is repeatedly caused. When the surge current level becomes lower than desired during the repeated occurrence of the reignition, reignition ceases to be caused due to an insufficient amount of the ionized heated gas supplied to the reigniting spark gaps through the paths 23 and 24. Accordingly, the arcs 25 and 26 are further driven to be extended up to a final position to become an arc 29 along the circumference of the arc extinguishing chamber. This arc 29 is cooled and extinguished by the arc extinguishing plates to cause the following current to be interrupted. The depth of the arc extinguishing chamber portion at the final position of the arc may be made smaller than that of the remaining chamber portion.

It is to be noted that reignition is caused in those interspaces between the auxiliary electrode and respective main electrodes which are spaced apart from the spark starting gap 17 and is not caused in an interspace between the main electrodes, eliminating the drawbacks of the prior art reigniting spark gap device.

Figure 3:
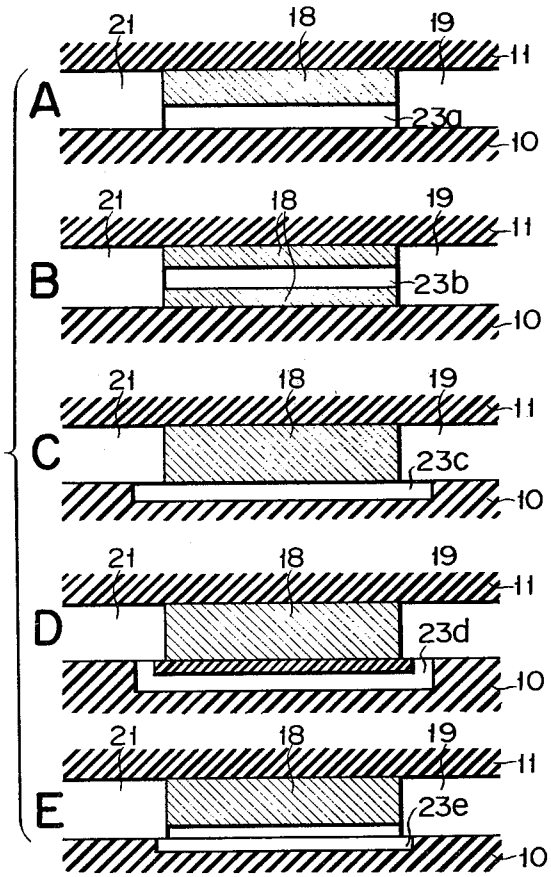
FIG. 3 (A–E) illustrates a variety of modifications of the enlarged sectional views taken along the line 3—3 of FIG. 2A.

The construction of the aforesaid paths can be modified in various ways as shown in FIG. 3. FIGS. 3A to 3E are enlarged sectional views taken along line 3—3 of FIG. 2A, illustrating the modified paths. FIG. 3A illustrates a construction wherein a groove **23*a* is provided in the auxiliary electrode itself, FIG. 3B a construction wherein a path 23*b* is provided through the auxiliary electrode, FIG. 3C a construction wherein a groove 23*c* is provided in the arc extinguishing plate 10 itself, FIG. 3D a construction wherein a path 23*d* is provided in the arc extinguishing plate itself, and FIG. 3E a construction wherein a path 23*e* is comprised of a groove formed in the arc extinguishing plate 10** and a groove formed in the auxiliary electrode.

Figure 4:
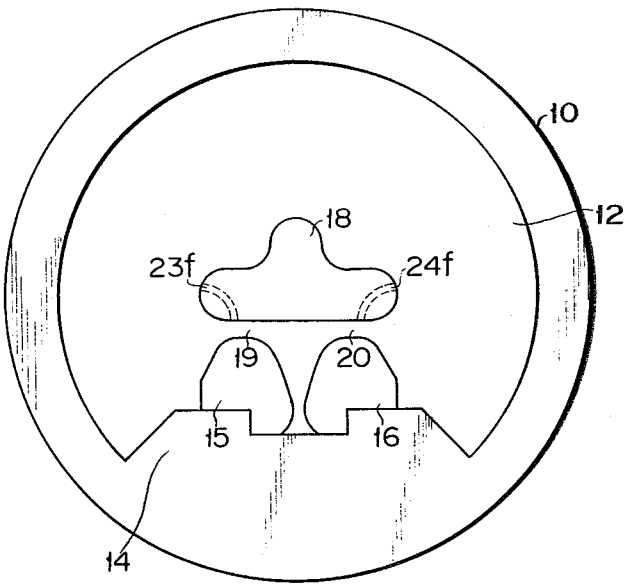
FIG. 4 is a plan view illustrating the inner construction of a second embodiment of the invention.

In a second embodiment illustrated in FIG. 4, heated gas paths **23*f* and 24*f* provided in the auxiliary electrode 18 are formed into arcuate shapes connecting the substantial sides of the auxiliary electrode to the reigniting spark gaps 19 and 20**, respectively.

Figure 5A:
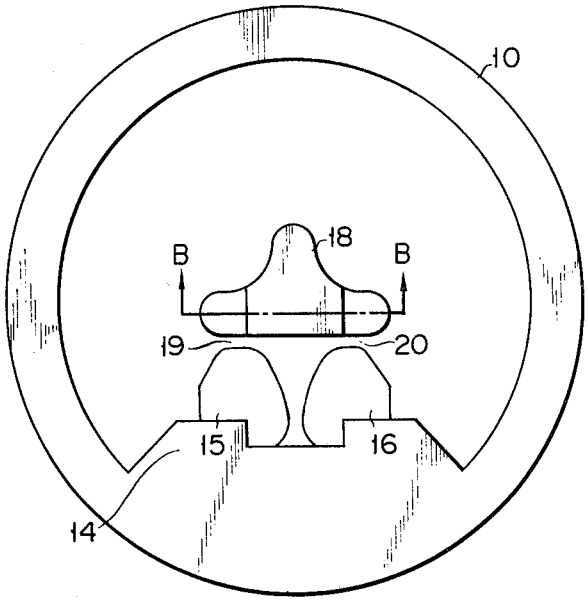
FIGS. 5A and 5B illustrate a third embodiment of the invention, FIG. 5A being a plan view illustrating the inner construction of the third embodiment, FIG. 5B being a sectional view taken along the line B—B of FIG. 5A.
Figure 5B:
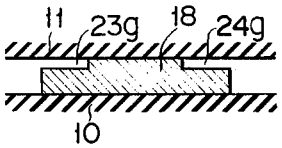

In a third embodiment illustrated in FIGS. 5A and 5B, heated gas paths are shown as grooves **23*g* and 24*g* defined between the arc extinguishing plate 11** and the respective cut-out portions of the two end portions of the auxiliary electrode.

Figure 6A:
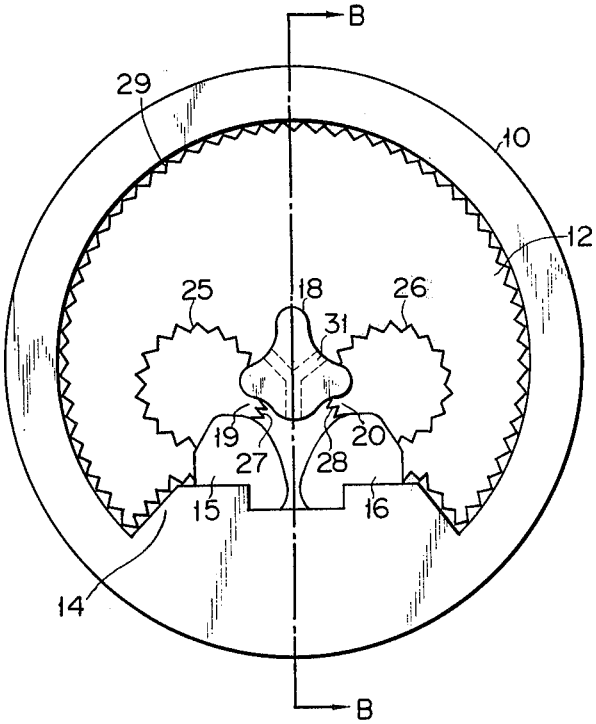
FIGS. 6A and 6B illustrate a fourth embodiment of the invention, FIG. 6A being a plan view illustrating the inner construction of the fourth embodiment, FIG. 6B being a sectional view taken along the line B—B of FIG. 6A.
Figure 6B:
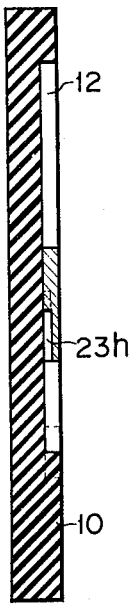

In a fourth embodiment illustrated in FIGS. 6A and 6B, a heated gas path **23*h* is shown as defined between one inner surface of the arc extinguishing chamber 10 and a Y-shaped groove 31 formed in the auxiliary electrode 18. Though the opening of the path 23*h* directed to the main electrode side is made single, said opening is positioned nearer to the reigniting spark gaps 19 and 20** than to the spark starting gap. As the result, a reignition similar to that explained in the first embodiment (FIGS. 2A and 2B) is repeatedly caused. The foregoing construction of the heated gas path is capable of preventing the reignition from being caused only in either one of the reigniting spark gaps, that is, of rendering it easier to control the reignition.

Figure 7B:
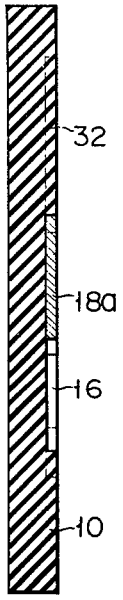
FIGS. 7A and 7B illustrate a fifth embodiment of the invention, FIG. 7A being a plan view illustrating the inner construction of the fifth embodiment, FIG. 7B being a sectional view taken along the line B—B of FIG. 7A.
Figure 7A:
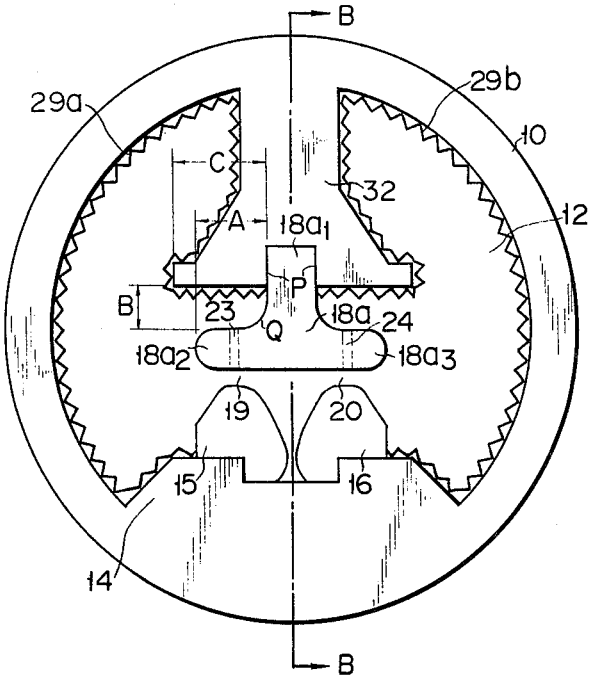

In a fifth embodiment illustrated in FIGS. 7A and 7B, for the purpose of dividing the arc 29 at the final position of FIG. 2A into two parts **29*a* and 29*b*, an insulating barrier 32 is provided in a manner integral with the arc extinguishing plate 10, and the upper projection $18a_1$ of the auxiliary electrode 18*a* is coupled to the lower portion of said barrier. Where no insulating barrier is provided, it often happens that the upper feet of the halved arcs stay for a while in the proximities of the upper path openings of the auxiliary electrode even where the level of surge current is reduced to a value smaller than prescribed. When the upper feet of the arcs stay in the proximities of the upper openings of the heated gas paths 23 and 24, it frequently happens that reignition is caused even after the level of surge current has been reduced to a value smaller than predetermined. In such cases, a larger length of time is required for the following current to be interrupted. It was discovered from a large number of experiments that the insulating barrier 32 so acts as to prevent the aforesaid stay of the arc feet. In more detail, when a reignited arc extended up to an arcuate line connecting the main electrode 15 to the illustrated upper opening of the heated gas path 23 of the auxiliary electrode 18***a* is further spread and thereby rendered tangent to the bottom surface of the barrier 32, the arc foot at the upper opening of theh gas path 23 is shifted to, for example, a point Q of the auxiliary electrode. Thereafter, the arc is further extended to become an arc 29*a*. Accordingly, the foot of an arc having a lower level of current than desired is prevented from staying at the upper opening of the gas path 23, and thus said arc is extended up to the illustrated final position. The same reference applies also to a reignited arc produced between the main electrode 16 and the auxiliary electrode.

As seen from FIG. 7A, the auxiliary electrode 18*a* and the insulating barrier 32 respectively assume a configuration symmetrical about a geometric symmetry plane passing through the center of the spark starting gap between the paired main electrodes and dividing the arc extinguishing chamber 12 into two parts. Further, the auxiliary electrode comprises a first projection $18a_1$ having side faces P extending parallel to said symmetry plane at prescribed distances therefrom and second and third projections $18a_2$ and $18a_3$ intersecting said first projection at right angles on the main electrode side and extending by the extend to A from said side faces P in a direction in which the main electrodes are arranged. Further, the insulating barrier 32 comprises an end portion extending by the extent of C from said side faces at a distance of B from the upper face of the second projection $18a_2$ of the auxiliary electrode in a direction in which the main electrodes are arranged and coupled to the first projection $18a_1$ of the auxiliary electrode. From the results of many experiments it was confirmed that it is when the condition of $B<A<C$ is satisfied that in the arc region having a lower level of current the arc is quickly driven up to the illustrated final position without causing the foot thereof to stay in the vicinity of the upper path opening of the auxiliary electrode.

Figure 8:
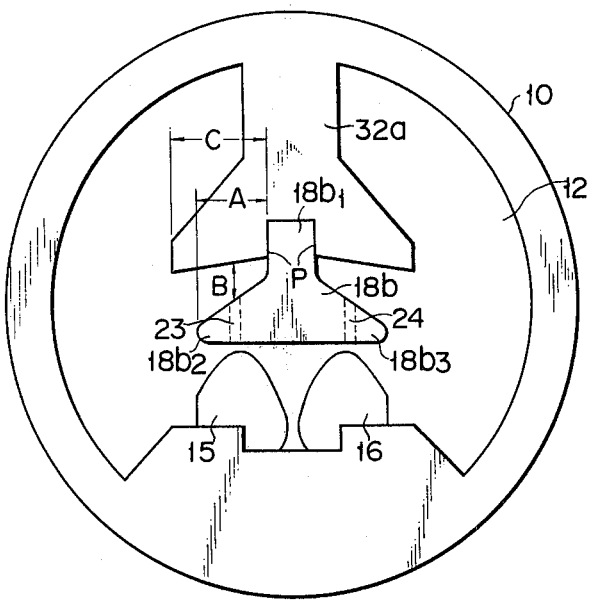
FIG. 8 is a plan view illustrating the inner construction of a sixth embodiment (a modification of FIGS. 7A and 7B) of the invention.

FIG. 8 illustrates a sixth embodiment based on a further modification of the fifth embodiment illustrated in FIGS. 7A and 7B. The sixth embodiment is distinguished from the fifth embodiment in that the upper faces of the second and third projections $18b_2$ and $18b_3$ of an auxiliary electrode 18*b* have a sharper inclination and in that the bottom surface of an insulating barrier 32*a* is inclined toward both end sides thereof symmetrically about the geometric symmetry plane. In this case, if, in case the distance between the upper opening of the heated gas path 23 of the auxiliary electrode and the inclined plane of the insulating barrier is expressed by B, the distances A, B and C are so determined as to meet the condition of $B<A<C$, the same effect as that obtainable with the fifth embodiment of FIG. 7A will be attained.

Figure 9:
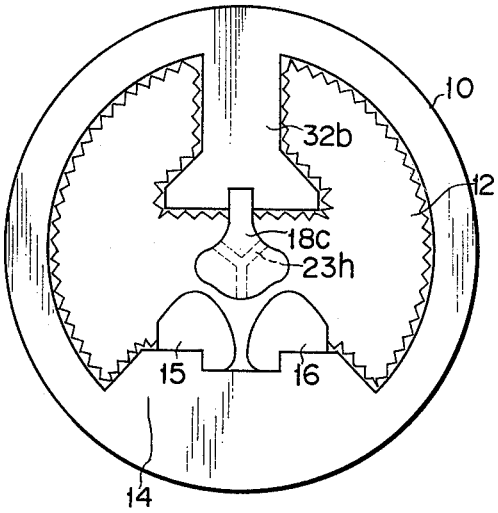
FIG. 9 is a plan view illustrating the inner construction of a seventh embodiment of the invention.

In a seventh embodiment illustrated in FIG. 9, an auxiliary electrode 18*c* coupled to an insulating barrier 32*b* has the same construction as that of the auxiliary electrode illustrated in FIG. 6A, and has a Y-shaped gas path 23*h*.

Figure 10:
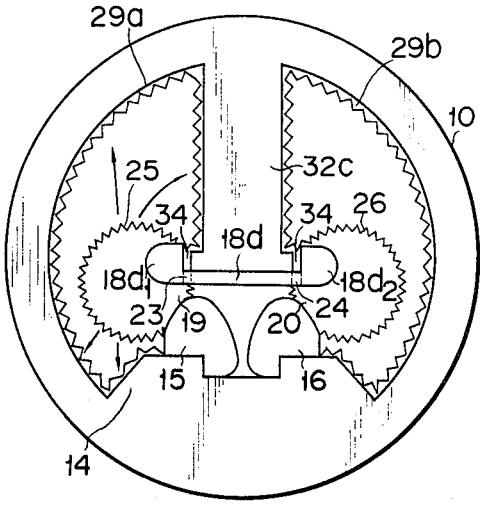
FIG. 10 is a plan view illustrating the inner construction of an eighth embodiment of the invention.

In an eighth embodiment illustrated in FIG. 10, a wide groove is provided between the end portions $18d_1$ and $18d_2$ of an auxiliary electrode 18*d*, and the bottom surface of said groove is secured to the end surface of an insulating barrier 32*c*, and further gaps 34 are formed between the end side surfaces of said groove and the end side surfaces of the insulating barrier, and gas paths 23 and 24 are provided so as to communicate with said gaps, respectively. This construction is suited for treating a surge current having such a waveform as is shown in FIG. 1C. That is to say, during the interval in which the level of surge current, shown in FIG. 1C, in the starting period is low, an arc produced in the spark starting gap is instantaneously driven to cause the upper feet of the arcs 25 and 26 to arrive at the respective gaps 34. Since, however, the arc current level is low, the upper feet of the arcs 25 and 26 stay for a while in the proximities of the gaps 34 even when no reignition is caused in the reigniting spark gaps 19 and 20. Next, when the surge current level becomes higher, the amount of a heated ionized gas passing through the paths 23 and 24 is increased with the result that so long as the surge current value is great, the reignition is repeatedly caused. Next, in the terminating period, the surge current value becomes again small, so that the occurrence of reignition is stopped. As the result, the arc is extended in directions indicated by arrows to reach the final positions (arcs 29*a*, 29*b*) and extinguished. The end portion of the insulating barrier 32*c* of this embodiment does not extend toward the end sides $18d_1$ and $18d_2$ of the auxiliary electrode, but the insulating barrier 32*c* divides the arc into two parts 29*a* and 29*b* at the final position, thereby to elongate the entire length of the arc, thus to increase the arc voltage.

Figure 11:
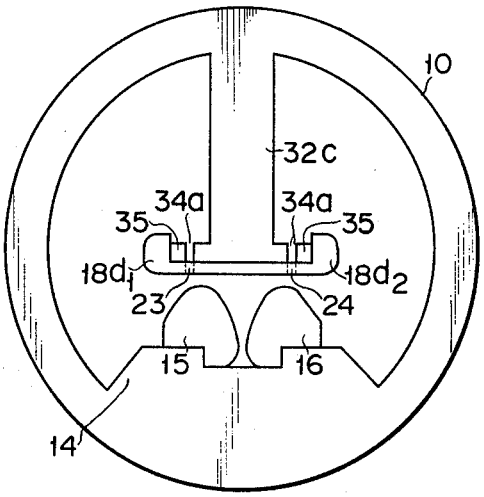
FIG. 11 is a plan view illustrating the inner construction of a ninth embodiment of the invention.

FIG. 11 illustrates a ninth embodiment based on a modification of the device illustrated in FIG. 10. The construction of this embodiment is such that the gaps 34 of FIG. 10 are respectively formed wider; insulating barriers 35 are inserted into the resultant gaps with gaps 34*a* remaining left; and the gas paths 23 and 24 are provided so as to communicate with the respective gaps 34*a*. In FIG. 10, those surfaces of the projections $18d_1$ and $18d_2$ of the auxiliary electrode 18*d* which defines the gaps 34 with the end side surfaces of the insulating barrier are likely to be damaged due to the stay thereat of the upper feet of the reignited arc to increase the widths of the gaps 34. In such cases, the amount of a heated gas supplied into the reigniting spark gap is increased, so that reignition is caused even due to an arc current whose level is lower than prescribed. On the contrary, since, in the embodiment illustrated in FIG. 11, both side faces of the gap 34*a* are constituted by the faces of the insulators, the gap width can always be kept constant, so that reignition can repeatedly be caused only where the arc current has a greater value than prescribed.

Figure 12B:
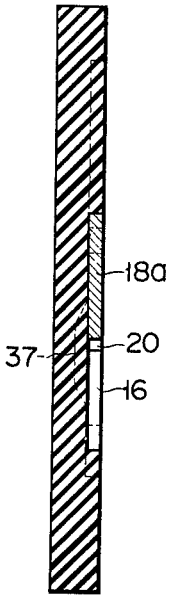
FIGS. 12A to 12C illustrate a tenth embodiment of the invention, FIG. 12A being a plan view illustrating the inner construction of the tenth embodiment, FIG. 12B being a sectional view taken along the line B—B of FIG. 12A, FIG. 12C being a sectional view taken along the line C—C of FIG. 12A.
Figure 12A:
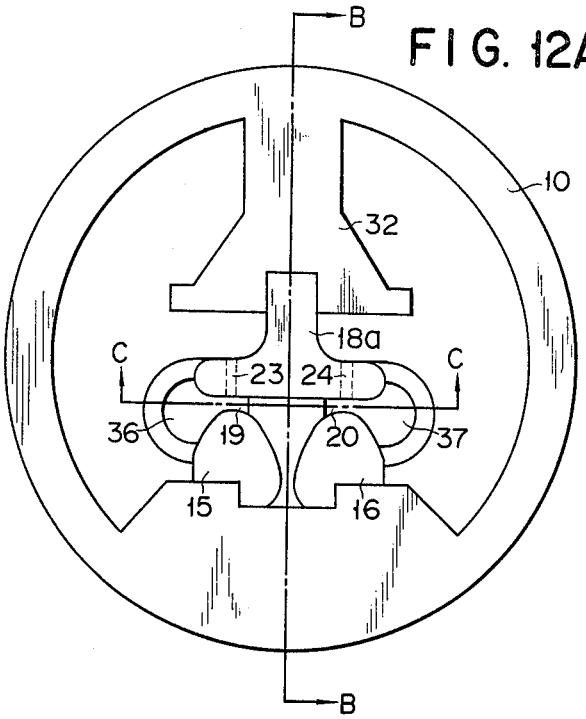

The wall of the arc extinguishing chamber portion where reignition is repeatedly caused is more likely to be deteriorated or damaged than the wall of the remaining chamber portion. FIGS. 12A and 12B illustrate a tenth embodiment of the invention wherein this drawback is eliminated. This embodiment has the same construction as that illustrated in FIGS. 7A and 7B except that recesses 36 and 37 are provided in those inner wall portions of the arc extinguishing plate 10 which are in the respective proximities of the reigniting spark gaps 19 and 20. Said recesses can be so formed as to have an appropriate depth, and by formation of said recesses the depth of the chamber portions corresponding to the recesses is rendered larger than the depth of the remaining chamber portion, thereby reducing the damages of the arc extinguishing plate due to the arc heat. These recesses may be provided in the inner wall of either one of or both of the arc extinguishing plates.

Figure 13:
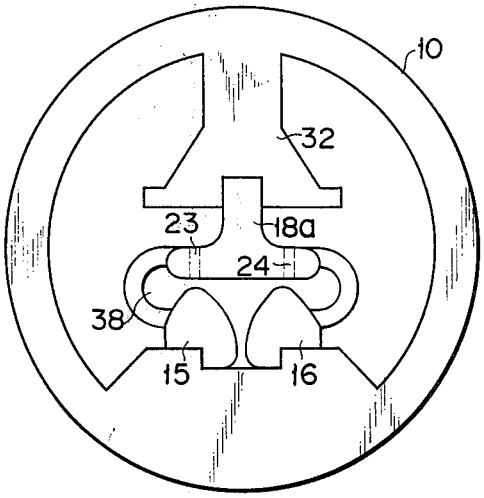
FIG. 13 is a plan view illustrating the inner construction of an eleventh embodiment (a modification of FIGS. 12A to 12C) of the invention.
Figure 12C:
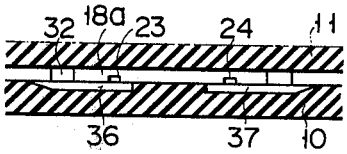

FIG. 13 illustrates an eleventh embodiment of the invention wherein the recesses 36 and 37 according to the embodiment of FIGS. 12A to 12C are made integral with each other to provide a single recess 38. The function and effect of this embodiment are the same as those obtainable with the embodiment illustrated in FIGS. 12A to 12C.

Figure 14:
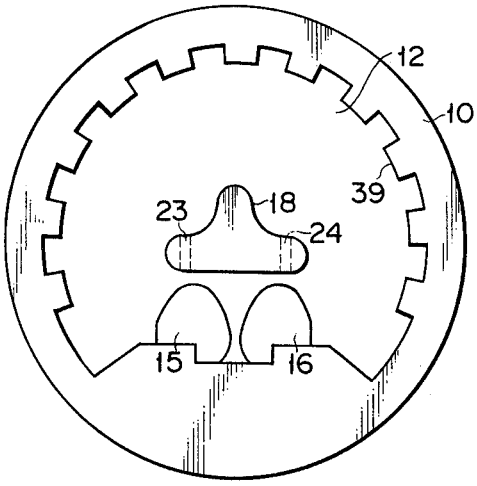
FIG. 14 is a plan view illustrating the inner construction of a twelfth embodiment (a modification of FIGS. 2A and 2B) of the invention.

FIG. 14 illustrates a twelfth embodiment of the invention wherein a plurality of protrusions 39 are provided on the peripheral wall of the arc extinguishing chamber for the purpose of further increasing the length of the arc at the final position indicated in the embodiment of FIGS. 2A and 2B.

Figure 15:
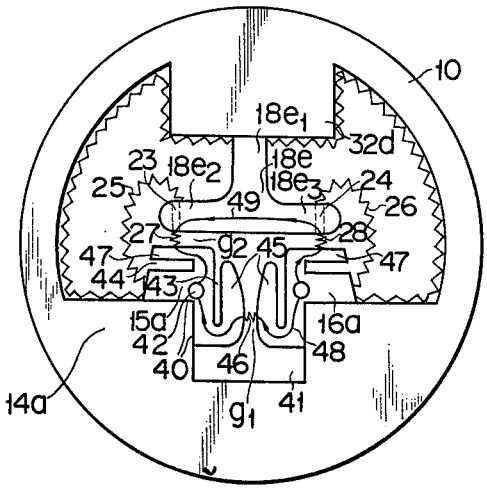
FIG. 15 is a plan view illustrating the inner construction of a thirteenth embodiment of the invention.

The starting spark between the paired main electrodes should reliably be caused at a point where the surge voltage has a prescribed level and simultaneously the reignition at the reigniting spark gap should also be caused at a point where the surge current has a prescribed level. Therefore, the width of the starting spark gap and the widths of the reigniting gaps should be adjusted previously. Further, not only the arc produced by the starting spark between the main electrodes but also the arc produced in the reigniting spark gap should quickly be driven. A thirteenth embodiment of the invention illustrated in FIG. 15 comprises main electrodes 15*a* and 16*a* enabling a precise adjustment of the widths of the gaps between said main electrodes and between the auxiliary electrode and said respective main electrodes and yet enabling a speedy drive of the arcs produced in these gaps. In the illustration, the first projecting section $18e_1$ of a reversed T-shaped auxiliary electrode 18*e* is in contact with the bottom surface of an insulating barrier 32*d*, and the illustrated lower end openings of the heated gas paths 23 and 24 formed through the second and third projecting sections $18e_2$ and $18e_3$, respectively, of the auxiliary electrode face the main electrodes, respectively. With respect to the main electrode 15*a*, the face 40 of the rectangularly cut-out section is, for example, adhered by epoxy resin to that face of the rectangularly projected section of the base portion 14*a* which forms one of the side walls of a groove 41 formed in the base portion 14*a*. The main electrode 15*a* is fitted over an electrical connection pin 42 thereby to be fixed to the arc extinguishing plate 10. In the main electrode portion defining a starting spark gap $g_1$ between the main electrodes is provided a slit 43 opened upwardly of the illustration. Further, in the main electrode portion defining a reigniting spark gap $g_2$ with the auxiliary electrode is provided a slit 44 opened to the left side of the illustration. The construction of the main electrode 16*a* is symmetrical with and accordingly quite the same as that of the main electrode 15*a*, and therefore description thereof is omitted. A starting spark arc 46 is produced upwardly projecting pieces 45 respectively isolated by the slits 43, and arcs 27 and 28 are produced between the auxiliary electrode 18*e* and projecting pieces 47 respectively isolated by the slits 44. The width of the gap $g_1$ is so chosen as to range between about 1 mm and 2 mm and the permissible error thereof is approximately ±5%. The permissible error of the width of the gap $g_2$ is also approximately ±5%. Even if the respective widths of the gaps $g_1$ and $g_2$ are precisely adjusted when the main electrodes are bonded to the base portion 14*a*, the width errors will be produced in the process of desiccating the bonding agent, so that minute adjustments of the gap widths become necessary after the bonding agent has been desiccated. By applying, in such cases, a slight mechanical force to the projecting pieces 45 and 47, desired or required minute adjustments can be made. Next, the starting arc 46 causes a current to flow along the illustrated path 48. The magnetic field produced due to the current flowing along said path so acts as to drive the arc 46 upwardly of the illustration. The current of initial reignited arcs 27 and 28 flows along the illustrated path 49. The magnetic field produced due to the current flowing along said path 49 so acts as to quickly drive the reignited arcs 27 and 28 toward arcs 25 and 26 (the final positions of arcs produced during the period in which reigniting spark is repeatedly caused), respectively. For the foregoing reasons, according to this embodiment, the respective spark gap widths can not only be precisely adjusted but the started arcs at the spark starting gap and reignition spark gaps can also be quickly driven.

The application or use of the lightning arrestor including therein the spark gap device according to the invention is not limited to the DC transmission line only. Further, the preceding embodiments referred to the case where the recess for forming the arc extinguishing chamber is provided in either one of the arc extinguishing plates, but a similar recess may of course be provided also in the other.

What we claim is:

1. A spark gap device for a lightning arrestor comprising an arc extinguishing chamber defined by arc extinguishing plates; a pair of main electrodes disposed within said arc extinguishing chamber to form a spark starting gap between facing surface portions thereof; an auxiliary electrode having a first surface facing said pair of main electrodes and a pair of second surface portions opposite to said first surface, said first surface forming a pair of reigniting spark gaps with respect to said main electrodes respectively at a first space portion between said first surface and said main electrodes, and said second surface portions each serving as a temporary arc foot point of an arc extended between said second surface portion and one of said main electrodes; said pair of second surface portions defining respective second space portions adjacent to said second surface portions and remote from said first space portion, and heated gas passing means for conducting heated gas between said second space portions and said first space portion and for causing reigniting sparks at said reigniting spark gap when the amount of each expanded arc current exceeds a predetermined value.

2. A spark gap device for a lightning arrestor according to claim 1 wherein said heated gas passing means includes at least a groove formed in the auxiliary electrode for conducting heated gas.

3. A spark gap device for a lightning arrestor according to claim 1 wherein said heated gas passing means includes at least a through hole formed through the auxiliary electrode for conducting heated gas.

4. A spark gap device for a lightning arrestor according to claim 1 wherein said heated gas passing means includes at least a groove formed in at least one of the arc extinguishing plates for conducting heated gas.

5. A spark gap device for a lightning arrestor according to claim 1 wherein said heated gas passing means includes at least a through hole formed in one of the arc extinguishing plates along the inner wall thereof for conducting heated gas.

6. A spark gap device for a lightning arrestor according to claim 1 wherein said heated gas passing means includes at least one passage defined by a groove formed in the auxiliary electrode and a groove formed in the inner wall of one of the arc extinguishing plates for conducting heated gas.

7. A spark gap device for a lightning arrestor according to claim 1 further comprising an insulating barrier having an end portion on the main electrode side coupled to said auxiliary electrode to divide into two parts an arc formed about said chamber.

8. A spark gap device for a lightning arrestor according to claim 7 wherein said auxiliary electrode and said insulating barrier respectively are symmetrical about a geometric symmetry plane passing through the center of the spark starting gap between the paired main electrodes and symmetrically dividing said arc extinguishing chamber into two parts; said auxiliary electrode comprising a first projection having side faces extending parallel to said symmetry plane at a predetermined distance therefrom and second projections intersecting said first projection at right angles thereto on the main electrode side and extending a predetermined distance A from said side faces in a direction in which the main electrodes are arranged; and said insulating barrier comprises a free end section having a pair of edge portions projecting in said direction in which the main electrodes are arranged, said edge portions each extending a predetermined distance C from said side faces at a specified distance B from the upper face of said second projections of said auxiliary electrode in said direction in which said main electrodes are arranged, said free end section being coupled to said first projection of said auxiliary electrode, said distances A, B and C being selected such that $B<A<C$.

9. A spark gap device for a lightning arrestor according to claim 7 wherein said auxiliary electrode and said insulating barrier respectively are symmetrical about a geometric symmetry plane passing through the center of the spark starting gap between the paired main electrodes and symmetrically dividing said arc extinguishing chamber into two parts; said auxiliary electrode comprising a first projection having side faces extending parallel to said symmetry plane at a predetermined distance therefrom, second projections intersecting said first projection at right angles thereto on the main electrode side and extending a predetermined distance A from said side faces in a direction in which the main electrodes are arranged, said heated gas passing means being formed in said second projections; and said insulating barrier comprising a free end section whose bottom surface passes through the points spaced a predetermined distance B from the openings on the barrier side of said heated gas paths and, while being inclined toward the arrangement of said main electrodes, extends a predetermined distance C from said side faces of the first projection of said auxiliary electrode and which is coupled to the first projection of said auxiliary electrode, said distances A, B and C being selected such that $B<A<C$.

10. A spark gap device for a lightning arrestor according to claim 7 wherein said auxiliary electrode has a first groove at a longitudinal intermediate portion thereof for reception over the free end of the insulating barrier, the side faces of said auxiliary electrode defining second grooves opened at the barrier side together with the respective side faces of the insulating barrier, said second grooves communicating with said heated gas paths.

11. A spark gap device for a lightning arrestor according to claim 1 wherein said paired main electrodes are respectively provided with first and second projecting pieces displaceable relative to the main electrode body, said first projecting piece being provided as a section constituting part of the spark starting gap between the paired main electrodes and displaceable to minutely adjust the spark starting gap width, said second projecting piece being provided as a section constituting part of each of the reigniting spark gaps between the auxiliary electrode and the respective main electrodes and displaceable to minutely adjust the reigniting spark gap widths.

12. A spark gap device for a lightning arrestor according to claim 1 wherein the thickness of the arc extinguishing chamber portion containing therein at least said reigniting spark gaps, the proximities thereof and the portion where the arcs produced in the reigniting spark gaps are repeatedly driven is greater than the thickness of the remaining arc extinguishing chamber portion.

* * * * *